US005522464A

United States Patent [19]

Piper

[11] Patent Number: 5,522,464

[45] Date of Patent: Jun. 4, 1996

[54] HYDRAULIC TUBING HEAD ASSEMBLY

[75] Inventor: Britton J. Piper, Edmond, Okla.

[73] Assignee: Piper Oilfield Products, Inc., Oklahoma City, Okla.

[21] Appl. No.: 439,493

[22] Filed: May 12, 1995

[51] Int. Cl.[6] ..... E21B 33/043

[52] U.S. Cl. ..... 166/77.2; 166/88.3; 166/212; 166/88.4

[58] Field of Search ..... 166/77.2, 88.2–88.4, 166/212, 382, 384

[56] References Cited

U.S. PATENT DOCUMENTS

| | | | |
|---|---|---|---|
| 3,373,816 | 3/1968 | Cochran | 166/46 |
| 3,675,719 | 7/1972 | Slator et al. | 166/297 |
| 3,690,381 | 9/1972 | Slator et al. | 166/315 |
| 3,692,107 | 9/1972 | Slator et al. | 166/55 |
| 4,621,403 | 11/1986 | Babb et al. | 29/433 |
| 4,844,166 | 7/1989 | Going, III et al. | 166/379 |
| 4,986,362 | 1/1991 | Pleasants | 166/382 |
| 5,027,903 | 7/1991 | Gipson | 166/382 |
| 5,092,400 | 3/1992 | Jagert | 166/88.2 |
| 5,411,081 | 5/1995 | Moore et al. | 166/120 |
| 5,411,085 | 5/1995 | Moore et al. | 166/384 X |
| 5,413,170 | 5/1995 | Moore | 166/98 X |
| 5,423,383 | 6/1995 | Pringle | 166/321 |
| 5,425,420 | 6/1995 | Pringle | 166/242.2 |
| 5,465,793 | 11/1995 | Pringle | 166/319 |

OTHER PUBLICATIONS

Brochure entitled "*SafeSet" Coil Tubing Hangers* published by Pedcor, Inc. of Houston, Texas.

*Primary Examiner*—Roger Schoeppel
*Attorney, Agent, or Firm*—Dougherty, Hessin, Beavers & Gilbert

[57] ABSTRACT

A hanger head assembly for coiled tubing that consists of a body member having an axial passage that includes plural, hydraulically actuated slips for holding the tubing at a selected position, and further includes a concentration double packer assembly that is hydraulically actuated to seal off the tubing annulus.

20 Claims, 3 Drawing Sheets

HYDRAULIC TUBING HEAD ASSEMBLY

BACKGROUND OF THE INVENTION

1. Field of the Invention.

The invention relates generally to wellhead apparatus for receiving coiled tubing and, more particularly, but not by way of limitation, it relates to improved tubing hanger apparatus in combination with a hydraulically actuated double packer configuration.

2. Description of the Prior Art

The prior art includes numerous types of tubing hanger assembly that have been largely restricted to the mechanical fastener types that use slips or clamping jaws to hold the tubing rigidly at a predetermined position in the annulus of a wellbore. U.S. Pat. Nos. 3,675,719; 3,690,381; and 3,692,107 in the name of Slator et al. are directed to a pair of semi-circular gripping and support members which are suitably clamped about a tubing at a designated position and maintained clamped with upward directed clamping teeth securing the tubing. A circular array of threaded rods then serve to maintain clamping pressure to retain the tubing, and such threaded rods are accessible from outside of the hanger assembly at the wellhead position. There are many variations on such mechanical hanger assembly and these are shown and described in the patents cited in the Information Disclosure Statement.

More recent hanger assemblies function by using a circumfery of downwardly directed slips which define a circular bore having upwardly directed teeth, which slips rest on an inwardly directed surface inclined to contact with the coiled tubing. Such assemblies are known as threaded coiled tubing hangers and function by turning an upper hanger section relative to a lower hanger section thereby to force the circumfery of slips downward and inward around the tubing until sufficient hanging grip is exerted. A still more recent coiled tubing hanger is termed the SAFESET™ coiled tubing hanger as manufactured by Pedcor of Houston, Tex. This hanger includes a body assembly with axial passage for tubing insertion whereupon a circumfery of slip activation screws are rotated to move the slips downward and inward to a position adjacent the tubing in gripping relationship. Simultaneously, as the slips move downward and inward, they bear against a slip support cup adjacent the central bore which, in turn, compresses a packer element to expand inward into contact with the tubing thereby to seal off the annulus immediately around the coiled tubing.

SUMMARY OF THE INVENTION

The present invention relates to an improved type of hanger assembly for use with coiled tubing which provides immediate hydraulic actuation of both slip positioning and setting of a dual packer element. The hanger assembly includes a body member and necessary flanges and adapters for securing into the wellhead structure. The body member includes an axial bore downward therethrough which intersects at an intermediate position with a frustoconical slip bowl wherein a 120° spaced array of upwardly toothed slips is slidably positioned. Plural hydraulic actuators are then mounted in the body member so that actuator rods are pivotally connected to respective slips to be driven downward and inward into contact with continuous tubing at a designated position. The lower part of the body member includes a central, cylindrical cavity which receives inner and outer packers in concentric array with the inner packer defining the central bore such that application of hydraulic fluid under pressure expands the packer inward into sealing relationship around the tubing passing therethrough.

Therefore, it is an object of the present invention to provide a coiled tubing hanger assembly that functions rapidly and reliably to seize and hold tubing at a designated position.

It is also an object of the present invention to provide an improved hanger assembly that may be actuated hydraulically to seal off the annulus around the tubing at the same time that the tubing holding function is initiated.

It is yet further an object of the present invention to provide a tubing head assembly that effects setting and retraction of slips around coiled tubing instantaneously while maintaining control of the annulus at all times.

Finally, it is an object of the invention to provide a safe and reliable tubing head assembly that is operable from a remote location.

Other objects and advantages of the invention will be evident from the following detailed description when read in conjunction with the accompanying drawings which illustrate the invention.

DETAILED DESCRIPTION OF THE INVENTION

Figure 1:
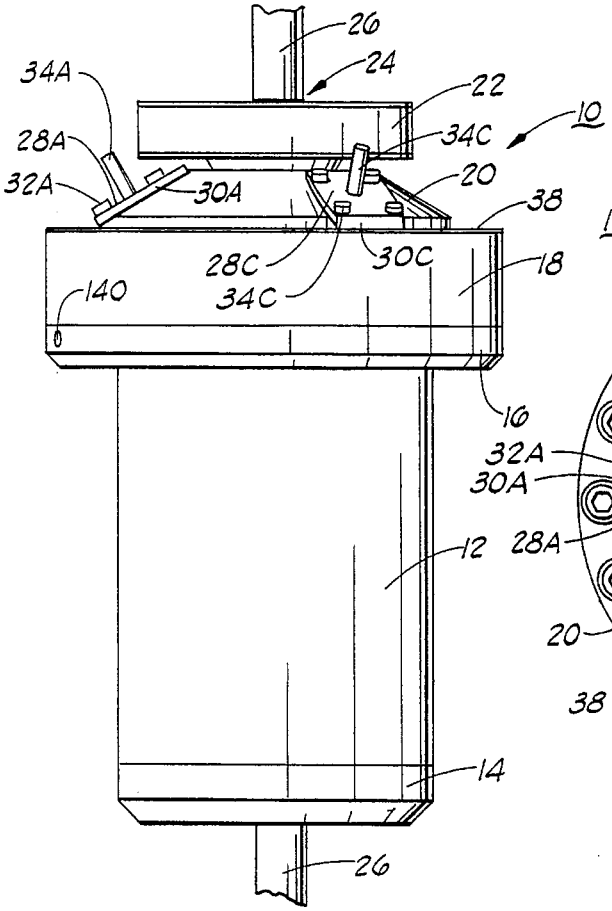
FIG. 1 is a view in elevation of the hanger assembly with tubing inserted.
Figure 2:
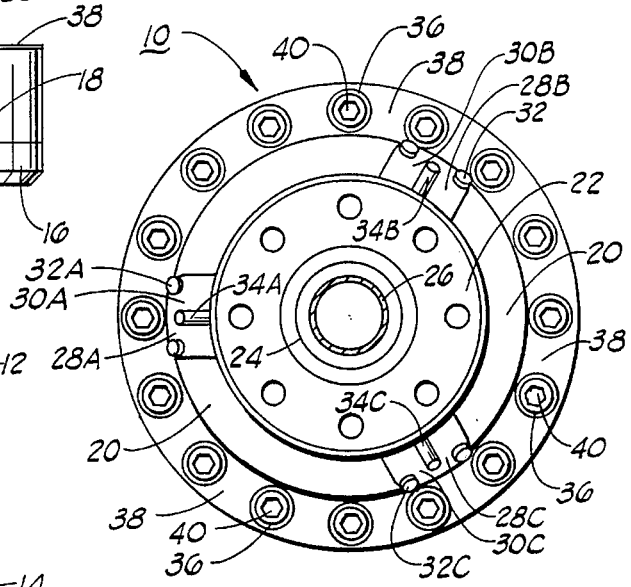
FIG. 2 is a top plan view of the hanger assembly.

Referring to FIGS. 1 and 2, the tubing head 10 consists of a cylindrical body 12 with a lower adapter 14 being threadedly received therein. Lower adapter 14 can be furnished with a side outlet (not shown) to provide a means for venting annulus pressure. A slip bonnet 16 is threadedly received in the top end of body 12 and a bonnet 18 is secured thereover by means of cap screws, to be further described. The bonnet 18 is formed with an upper angular face 20 and a threaded central bore for receiving upper adapter 22 downward therein. A central bore 24 (FIG. 2) is formed downwardly through the entire tubing hanger head 10 as a segment of tubing 26 from a coiled tubing source or reel extends downward therethrough. Tubing 26 is not shown in FIG. 2 for purposes of clarity.

A plurality of slip cylinder assemblies 28A, 28B and 28C are inserted around the bonnet angle surface 20 in equal spacing. In this case, there are three slip cylinder assemblies 28A–C at 120° spacing. The slip cylinder assemblies are inserted through the angular surface 20 of bonnet 18 flush to the surface so that slip piston reciprocation is on an axis lying at about 30° from the vertical axis of the central bore 24. Each of the slip cylinder heads 30A, 30B and 30C is secured in position by means of four-corner allen head screws 32A, 32B and 32C. Outer piston rod ends 34A, 34B and 34C are reciprocal through a sealed aperture in the respective slip cylinder heads 30A, 30B and 30C.

A plurality of bores 36, in this case sixteen, down through outer shoulder 38 of bonnet 18, provide position for a like plurality of cap screws 40 that secure threadedly into similarly spaced bores around slip bonnet 16, as will be further described below. The upper adapter 22 also includes a plurality, in this case, eight, of threaded bores 42 which function to receive bolt connection to a next sub or mating equipment that might be secured above the hanger head 10. In like manner, the lower adapter 14 includes a plurality, e.g., eight, upwardly directed threaded bores 44 for attachment to related wellhead assemblies, as shown in FIG. 3.

Figure 3:
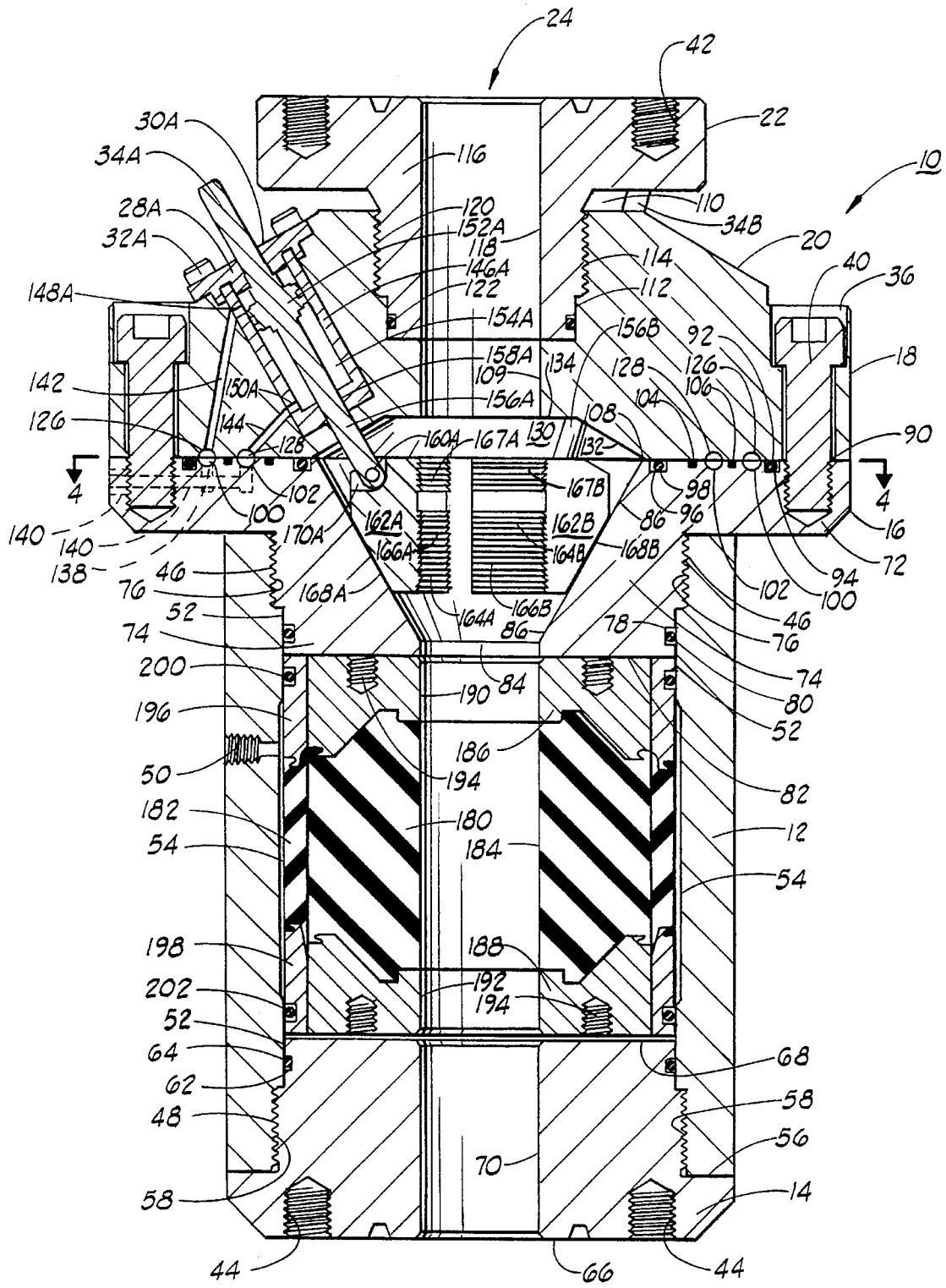
FIG. 3 is a vertical section of the hanger assembly.

Referring more particularly to FIG. 3, the hanger head body 12 is a cylindrical body having threaded counterbores 46 and 48 formed in the upper and lower ends, respectively, with a single threaded bore 50 for receiving connection of a hydraulic fluid supply. The threaded ends 46 and 48 upset to a cylindrical inner wall 52 which receives an intermediate counterbore 54 of relatively shallow offset. The counterbore 5.4 extends along most of the length of the inner bore between inner cylindrical walls 52 thereby to provide a minimal space for hydraulic fluid circulation adjacent the packer elements, as will be further described.

The lower adapter 14 is countercut to form a shoulder 56 and a surface of threads 58 for mating engagement with threads 48 of body 12. The lower adapter 14 then includes an interior cylindrical surface 60 which includes an annular groove 62 and sealing ring 64 for sealing contact adjacent the bottom side of inner cylindrical wall 52 of body 12. A lower surface 66 and upper surface 68 of lower adapter 14 terminate centrally in an axial bore 70 which also aligns with and forms a part of the central bore 24. The axial bore 70 is chamfered as are all individual bores up along the various elements of hanger head 10.

The slip bonnet 16 consists of an annular plate 72 that is reduced to an annular extension 74 having threads 76 formed for mating engagement with upper threads 46 of cylindrical body 12. The lower end of cylindrical body 74 includes an annular groove 78 and sealing ring 80 for sealing engagement within the upper portion of cylindrical wall 52 of body 12. A bottom annular surface 82 of slip bonnet 16 includes a central bore 84, which central bore 84 intersects upwardly with a frustoconical slip chamber 86, to be further described.

The upper annular surface 88 of slip bonnet 16 actually constitutes a channel plate wherein a plurality of concentric sealing and fluid supply channels are formed. See FIG. 4. First, a plurality, in this case, sixteen, of threaded cap screw holes 90 are formed around the periphery to receive threaded engagement with the cap screws 40 (FIG. 2). Then, the surface 88 includes a plurality of annular surface formations that contribute varying functions. An outer groove 92 and sealing ring 94 provide a seal to the exterior while an inner groove 96 and sealing ring 98 provide sealing to the interior. A groove 100 adjacent outer groove 92 combines with a mating groove, as will be described, to provide annular hydraulic fluid flow, and a groove 102 disposed inward therefrom also provides annular hydraulic fluid flow. A pair of seal grooves 104 and 106 disposed on each side of groove 102 provides further isolation between the concentric grooves. Finally, the upper annular surface 88 terminates inwardly at the upper end 108 of conical surface 86.

The bonnet 18 is formed with annular shoulder 38 and upper angular face 20 surrounding a top, axially centered face 110. An axial bore 112 is formed with threads 114 to receive an upper adapter 22. Thus, upper adapter 22 includes an axial extension 116 defining axial bore 118 interiorly and including threads 120 adjacent a sealing ring 122. The upper adapter 22 is securely threaded into bonnet 18 and axial bore 118 aligns with the bonnet interior bore 109 thereby to complete the central bore 24 along the length of tubing hanger head 10.

A lower annular face 124 of bonnet 18 includes annular channels 126 and 128 which mate with respective channels 100 and 102 of annular surface 88 of slip bonnet 16 to form annular fluid channels. The inward edge of annular surface 88 is the rim point 108 of the frustoconical wall 86 which forms the major portion of a slip chamber 130. The remainder of slip chamber 130 is bounded by an annular angle wall 132 and transverse annular surface 134 of bonnet 18.

Figure 4:
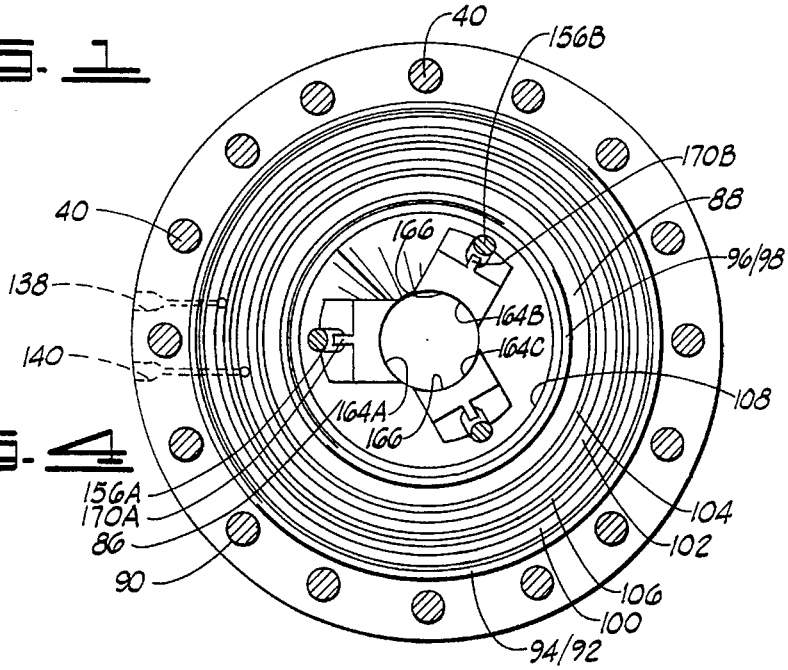
FIG. 4 is a view taken along lines 4—4 of FIG. 3.

As shown in FIG. 4, the lateral ports 138 and 140 are bored in parallel into shoulder 72 of slip bonnet 16 as they communicate with respective internal fluid ports 142 and 144. See FIG. 3. Each of slip cylinder heads 30A, 30B and 30C is coactively and sealingly connected to respective slip cylinders 146A, 146B and 146C which are fixed in position by means of cap screws 32 to receive fluid connection by means of cylinder ports 148 and 150. The slip piston rods 34A, B and C are reciprocally received through respective cylinder heads 30A, B and C as pistons 152A, B and C are reciprocal within cylinder chambers 154A, B and C. Inner rod ends 156A, B and C extend through bottom seals 158A, B and C whereupon they are secured by means of pivot pins 160A, B and C to bi-directional slips 162A, B and C.

Each of slips 162A, 162B and 162C (see FIG. 4) is similarly formed to have a front face 164A, 164B and 164C which is arcuately formed to define around the longitudinal central bore 24. Each of the arcuate slip faces 164A, 164B and 164C is faced with upward directed toothed striations 166A, 166B and 166C to provide a gripping surface for holding tubing extending down through central bore 24. A lesser number of down-directed teeth 167A, B and C are formed at the top of slips 162A, B and C to aid in gripping the tubing during upward or reverse tubing pressure situations that may be encountered. The slips 162A, 162B and 162C are each formed with an angular back side 168A, 168B and 168C which is formed in arcuate shape for sliding engagement with the conical surface of slip chamber wall 86. Each of the respective slips 162A, 162B and 162C is further formed with a pivot tab 170A, 170B and 170C which receives pivotal attachment to the respective inner rod ends 156A, 156B and 156C to apply reciprocal drive to the respective slips 162.

An inner packer 180 and outer packer 182 are disposed in concentric relationship within the body 12 between the lower adapter 14 and the slip bonnet 16. The inner packer 180 includes a central axial bore 184 as inner packer 180 is formed from hydrogenated nitrile rubber bonded to a pair of end rings for support under extremely high pressures, i.e., upper end ring 186 and lower end ring 188. The upper and lower end rings 186 and 188 are formed with respective axial bores 190 and 192 in alignment with the central bore 24. A plurality of threaded bores 194 disposed peripherally in each of end rings 190 and 192 provides access gripping means which aid in removal of inner packer 180 during disassembly of the tubing hanger 10. The bonding of packer 180 to respective end rings 186 and 188 is affected by conventional bonding process and ring configurations.

The outer packer 182 is also composed of hydrogenated nitrile rubber and bonded similarly to upper end ring 196 and lower end ring 198. The outer packer 182 is much thinner than the inner packer 180 and acts as a diaphragm to prevent hydraulic fluid from coming into contact with well contaminants while providing the force necessary to move the inner packer radially into the wellbore. Groove-seated upper and lower sealing rings 200 and 202 provide fluid-tight isolation of the packer assembly while the intermediate counterbore 54 of body 12 allows circulation of hydraulic fluid during actuation of the packer assembly. Hydraulic fluid is selectively applied via port 50 to control the packers 180 and 182.

In operation, the tubing head 10 is first assembled to include the proper size slip segments 162A, B and C. The plurality of cap screws 40 can be removed to remove the bonnet 18 which then opens the slip chamber 130. Three slips 162A, B and C are then selected which will accommodate the tubing diameter to be used, and the respective slips are pivotally attached on the lower rod ends 156A, B and C. The bonnet 18 is then realigned and fastened by insertion of all cap screws 40.

Figure 5:
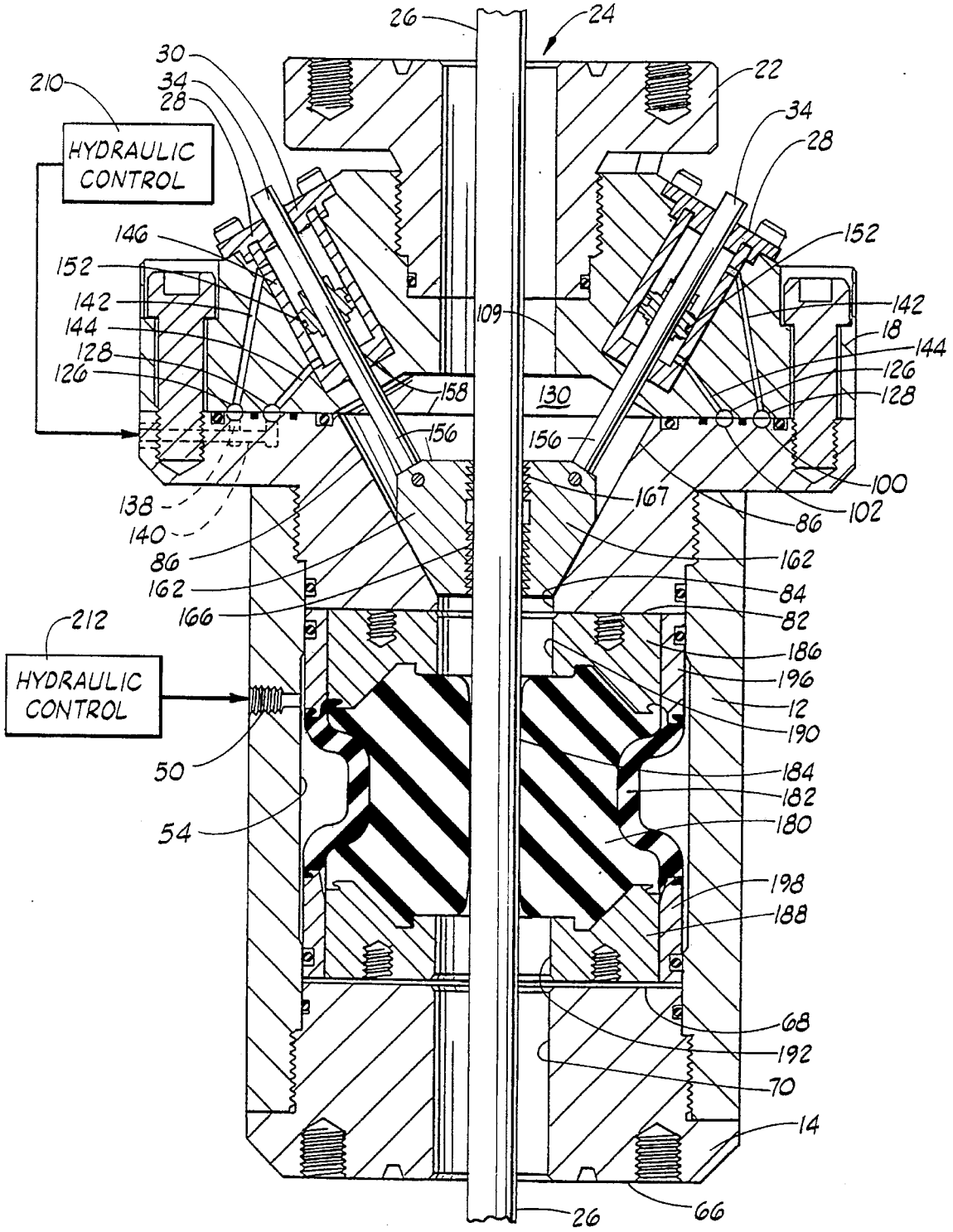
FIG. 5 is an idealized depiction of the hanger assembly in vertical section showing the energized slip elements and packers in balanced relationship, i.e., a dual slip 180° formation rather than the actual 120° spaced formations.

Referring primarily to FIG. 5, the tubing head 10, i.e., the bonnet 18 assembly and body 12, are capable of accepting a variety of adapter 14 flange sizes thereby to allow the tubing head assembly 10 to be installed on nearly any type or size of wellhead flange. Also, the upper adapter 22 is designed to accommodate a wide variety of wellhead fixture on top of the hanger assembly. When the tubing head 10 is properly secured, coiled tubing of selected outside diameter is inserted down through the central bore 24 to extend through the 120° spaced slips 162A, B and C, and through the axial bore 184 of inner packer 180 to extend on down into the borehole. Finally, hydraulic connections are made from hydraulic controls 210 to the input and output hydraulic ports 138 and 140 which function to effect control of the slip cylinders 28A, B and C as respective ports 138 and 140 communicate with annular fluid channels 126 and 128 which supply the respective port cylinders 142A, B and C and 144A, B and C to the respective slip cylinders 28A, B and C. A second hydraulic control 212 applies a control line to the port 50 (FIG. 5) which regulates fluid pressure to the surround of outer packer 182 via intermediate counter bore 54 (see FIG. 3).

Referring to the idealized depiction of FIG. 5, once the tubing 26 has been lowered to its designated depth the hanger function is initiated through hydraulic control 210 which circulates fluid pressure through groove conduits 126/100 and 128/102 (FIG. 3) to actuate the respective slip cylinders 28A, B and C so that pistons 152A, B and C are moved downward to position the respective slips 162A, B and C firmly against the tubing 26. The slips 162 wedge between the conical chamber face 86 and tubing 26 as the upwardly directed teeth 166 hold the tubing 26 tightly at that position. It should be kept in mind that FIG. 5 is an idealized view and that actually there are three such slips 162A, B and C equi-spaced around tubing 26.

Simultaneously, hydraulic control 212 is energized to conduct fluid through port 50 to the surround of outer packer 182 thereby to distend outer packer 182 (as shown) inward radially which, in turn, forces the inner packer 180 into tight seizure around tubing 26 thereby to seal off the annulus. The outer packer 182 acts as a diaphragm to prevent hydraulic fluid from coming into contact with well contaminants while providing the force necessary to extend the inner packer 180 into the wellbore. In effect, the inner packer 180 extrudes into the wellbore to seal the annulus or to seal over open hole; and by its design, the inner packer can sustain substantial damage and still seal because all hydraulic pressure is contained by the outer packer 182. This particular packing assembly can be used as an annular blow-out preventer during the running of coiled tubing string, and be can be used as the primary pack off once the slips 162 are set and the coiled tubing 26 is in position. The packer assembly requires no special maintenance and need only be visually inspected and tested after each job usage. The same packer is used for all coiled tubing sizes that will fit within central bore 24 and can close over open hole.

The slip array, or slips 162A, B and C, consists of three hydraulically actuated slip segments on 120° spacing around the wellbore. Each slip segment is attached to a hydraulic piston as described above. The hydraulic locking assemblies are designed such that when the slips 162A, B and C are retracted, each slip segment will be removed completely from the wellbore, i.e., outside of central bore 24. When the weight of the tubing string is transferred to the slips 162A, B and C, the tapered slip chamber 86 causes the slip segment to engage the pipe positively. To disengage the slips 162A, B and C from the tubing 26, it is only necessary to pick up on the tubing 26 and hydraulically retract the slips 162A, B and C. Since all three hydraulic locking assemblies operate on the same, internally ported, hydraulic circuit, the slip assemblies operate simultaneously and tend to keep the tubing 26 centered in the wellbore for ideal slip engagement. Both the "open" and "closed" hydraulic circuits include in-line check valves that prevent movement of the pistons once control lines are removed.

The foregoing discloses a novel form of coiled tubing hanger assembly that is capable of rapid, balanced actuation to apply plural wedging slips to grip coiled tubing at a designated entry level, while also being operable to actuate a double packer enclosure that seals around the tubing member. Both the slip assemblies and the double packer assembly are hydraulically actuated into operative position in rapid, reliable manner. The slip assembly and packer assembly are included in a tubing head that is threaded to accept a variety of adapter flange sizes thereby to allow the tubing head assembly to be installed on top of practically any size flange existing at the wellhead. Hydraulic actuation of the operable elements assures reliable and high strength operation of the slip segments and the packer seal off components.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A coiled tubing head assembly, comprising:

a body member having a cylindrical axial passage formed downward therethrough for receiving coiled tubing;

a downward directed frustoconical slip bowl formed coaxially along said axial passage;

a cylindrical cavity formed co-axially along said axial passage adjacent said slip bowl;

plural slips disposed in equal spacing in said slip bowl;

plural hydraulic actuators seated in equal spacing around the body member with each actuatable to move a respective slip into engagement with the tubing passing through the slip bowl;

inner and outer cylindrical packers disposed concentrically within said cylindrical cavity; and hydraulic means for constricting the outer cylindrical packer thereby to force the inner cylindrical packer inward around said tubing.

2. An assembly as set forth in claim 1 wherein said body member comprises:

a bonnet member having a lower face and defining an upper axial passage;

a slip bonnet having an upper face secured next to said bonnet member lower face and defining said frustoconical slip bowl;

a body member secured below said slip bonnet and defining said cylindrical cavity; and a lower adapter secured beneath the body member and defining a lower axial passage.

3. An assembly as set forth in claim 2 which further includes:

an upper adapter threadedly connected on said bonnet member defining an extension of said upper axial passage.

4. An assembly as set forth in claim 2 which further includes:

a pair of lower annular grooves formed around the lower face of the bonnet member;

a pair of upper annular grooves formed around the upper face of the slip bonnet, each in similar configuration to said respective lower annular grooves thereby to form a pair of annular ports;

first and second hydraulic ports formed generally radially in said slip bonnet to communicate from the exterior to one of the respective annular ports; and a plurality of pairs of ports formed in said bonnet member and communicating between respective ones of said annular ports and said plural hydraulic actuators.

5. An assembly as set forth in claim 1 wherein said plural slips each comprise:

a slip front face arcuately formed with gripping cleats to adhere to tubing when actuated;

an angular back surface for slidable disposal adjacent said frustoconical slip bowl; and a pivot tab for connection to a respective hydraulic actuator.

6. An assembly as set forth in claim 1 wherein said plural hydraulic actuators each comprise:

a slip cylinder having a sealed head and base and being mounted in said body member directed at said slip bowl;

a piston having a lower rod end sealingly disposed through said slip cylinder base to extend into pivotal affixture to a respective one of the plural slips; and hydraulic control means for actuating said slip cylinder piston to selectively position the respective lower rod end and slip.

7. An assembly as set forth in claim 6 which further includes:

a pair of lower annular grooves formed around the lower face of the bonnet member;

a pair of upper annular grooves formed around the upper face of the slip bonnet, each in similar configuration to said respective lower annular grooves thereby to form a pair of annular ports;

first and second hydraulic ports formed generally radially in said slip bonnet to communicate from the exterior to one of the respective annular ports; and a plurality of pairs of ports formed in said bonnet member and communicating between respective ones of said annular ports and said plural hydraulic actuators.

8. An assembly as set forth in claim 1 wherein said inner and outer cylindrical packers comprise:

an inner rubber cylinder defining said cylindrical axial passage;

an outer rubber cylinder about one-fourth of the radial thickness of said inner rubber cylinder;

a port through said body member adjacent said outer rubber cylinder; and hydraulic control means for applying hydraulic pressure through said port to constrict said outer rubber cylinder thereby to force said inner rubber cylinder inward to seal off the cylindrical axial passage.

9. An assembly as set forth in claim 8 wherein said inner rubber cylinder comprises:

upper and lower inner cylinder rings; and an inner cylinder of hydrogenated nitrile rubber bonded between said upper and lower inner cylinder rings.

10. An assembly as set forth in claim 8 wherein said outer rubber cylinder comprises:

upper and lower outer cylinder rings; and an outer cylinder of hydrogenated nitrile rubber bonded between said upper and lower outer cylinder rings.

11. An assembly as set forth in claim 1 wherein:

there are three slips each pivotally connected to a respective hydraulic actuator.

12. An assembly for use at a wellhead for securing coiled tubing in suspension, comprising:

a body member having a cylindrical axial passage formed downward to receive coiled tubing therethrough;

a downward directed frustoconical slip bowl formed coaxially along said axial passage;

plural slips disposed in equal spacing in said slip bowl; and plural hydraulic actuators seated in equi-spacing around the body member at an angle of approximately thirty degrees from said axial passageway with each actuatable to move a respective slip into engagement with tubing passing through the slip bowl.

13. An assembly as set forth in claim 12 wherein said plural slips each comprise:

a slip front face arcuately formed with gripping cleats to adhere to tubing when actuated;

an angular back surface for slidable disposal adjacent said frustoconical slip bowl; and a pivot tab for connection to a respective hydraulic actuator.

14. An assembly as set forth in claim 13 wherein said slip front face comprises:

a plurality of up-directed teeth disposed about the lower part of said front face; and a plurality of down-directed teeth disposed about the upper part of said front face.

15. An assembly as set forth in claim 12 wherein said plural hydraulic actuators each comprise:

a slip cylinder having a sealed head and base and being mounted in said body member directed at said slip bowl;

a piston having a lower rod end sealingly disposed through said slip cylinder base to extend into pivotal affixture to a respective one of the plural slips; and hydraulic control means for actuating said slip cylinder piston to selectively position the respective lower rod end and slip.

16. An assembly as set forth in claim 12 wherein said body member comprises:

a bonnet member having a lower face and defining an upper axial passage;

a slip bonnet having an upper face secured next to said bonnet member lower face and defining said frustoconical slip bowl; and a body cylinder secured below said slip bonnet.

17. An assembly as set forth in claim 16 which further includes:

a pair of lower annular grooves formed around the lower face of the bonnet member;

a pair of upper annular grooves formed around the upper face of the slip bonnet, each in similar configuration to said respective lower annular grooves thereby to form a pair of annular ports;

first and second hydraulic ports formed generally radially in said slip bonnet to communicate from the exterior to one of the respective annular ports; and a plurality of pairs of ports formed in said bonnet member and communicating between respective ones of said annular ports and said plural hydraulic actuators.

18. An assembly as set forth in claim 16 which further includes:

a lower adapter secured beneath the body cylinder to form a cylindrical space coaxial with said axial passage and below said slip bowl;

a packer member formed of rubber disposed in said cylindrical space in surround of said axial passage;

a port through said body cylinder into said cylindrical space; and hydraulic fluid means actuatable to constrict said packer member inward around said tubing to seal off the axial passage.

19. An assembly as set forth in claim 18 wherein said packer member comprises:

an inner rubber cylinder defining said cylindrical axial passage; and an outer rubber cylinder about one-fourth of the radial thickness of said inner rubber cylinder disposed concentrically thereon.

20. An assembly as set forth in claim 12 wherein: there are three such hydraulic actuators and respective slips.

* * * * *